United States Patent [19]

Gianfranco

[11] 4,277,921

[45] Jul. 14, 1981

[54] THREE-DIMENSIONAL COMPONENTAL MODULE AT "T" MODIFIED FOR THE INDUSTRIAL PREFORMATION OF BUILDINGS

[76] Inventor: Velo D. Gianfranco, Via Velo, 14, 35014 Fontaniva (Padova), Italy

[21] Appl. No.: 101,705

[22] Filed: Dec. 10, 1979

[30] Foreign Application Priority Data

Apr. 6, 1977 [IT] Italy ..... 41568 A/77
Aug. 26, 1977 [IT] Italy ..... 41670 A/77

[51] Int. Cl.[3] ..... E04H 9/06

[52] U.S. Cl. ..... 52/79.4; 52/79.11; 52/611; 52/236.7; 52/236.8; 52/220; 52/259

[58] Field of Search ..... 52/79.1, 79.4, 79.11, 52/236.7, 236.8, 236.9, 79.2, 79.13, 79.14, 134, 136, 608–611, 258, 259, 98–100, 220

[56] References Cited

U.S. PATENT DOCUMENTS

| | | | |
|---|---|---|---|
| 1,332,409 | 3/1920 | Pomerantz | 52/100 |
| 1,800,951 | 4/1931 | Miller | 52/435 |
| 3,323,266 | 6/1967 | Dalkas | 52/610 |
| 3,369,334 | 2/1968 | Berg | 52/227 |
| 3,635,354 | 1/1972 | Martin | 52/79.2 |
| 4,019,293 | 4/1977 | Armas | 52/259 |
| 4,048,772 | 9/1977 | Gaul | 52/136 |
| 4,136,492 | 1/1979 | Willingham | 52/79.4 |

FOREIGN PATENT DOCUMENTS

| | | | |
|---|---|---|---|
| 989134 | 5/1976 | Canada | 52/602 |
| 812829 | 9/1951 | Fed. Rep. of Germany | 52/259 |
| 518239 | 5/1921 | France | 52/611 |
| 1019250 | 10/1952 | France | 52/611 |
| 1033198 | 7/1953 | France | 52/434 |
| 370164 | 4/1932 | United Kingdom | 52/611 |

*Primary Examiner*—James L. Ridgill, Jr.
*Attorney, Agent, or Firm*—H. Dale Palmatier

[57] ABSTRACT

A three-dimensional componental module at "T" modified for industrial preformation of buildings, comprising a fundamental dissymmetrical module at "T" with a vertical slab substaining a horizontal slab presenting two flanges and on its upper surface projection-ribbings, said fundamental module developing prevalently in a longitudinal sense, is described. From said module are derived, by subtraction of the parts both of the horizontal and the vertical slabs, all the elements necessary and sufficient for the realization of buildings of the most varied distributive physionomy, means being foreseen for realizing, on said horizontal slab and on the heads of the adjacent elements, zones of casting in loco conveniently reinforced.

27 Claims, 44 Drawing Figures

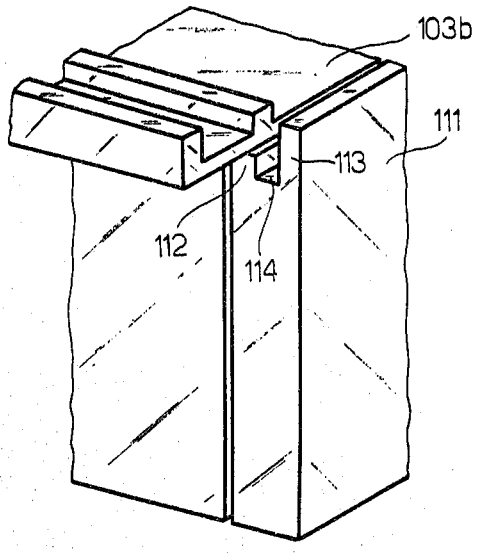
Fig.22
Fig.24
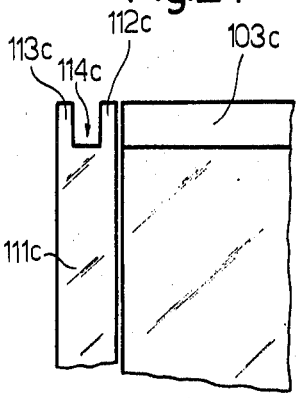
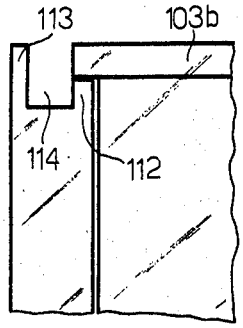
Fig.23
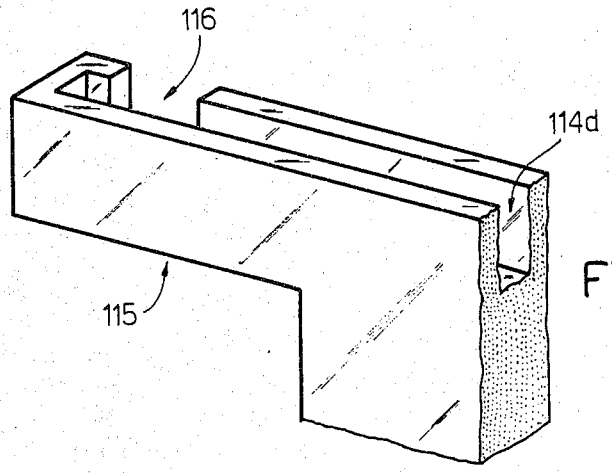
Fig.25

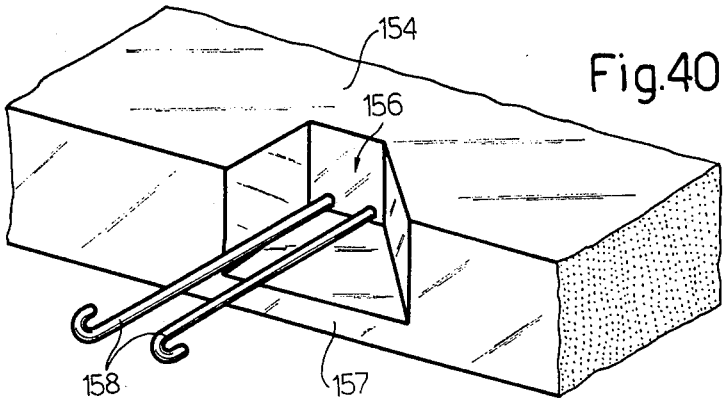
Fig.40
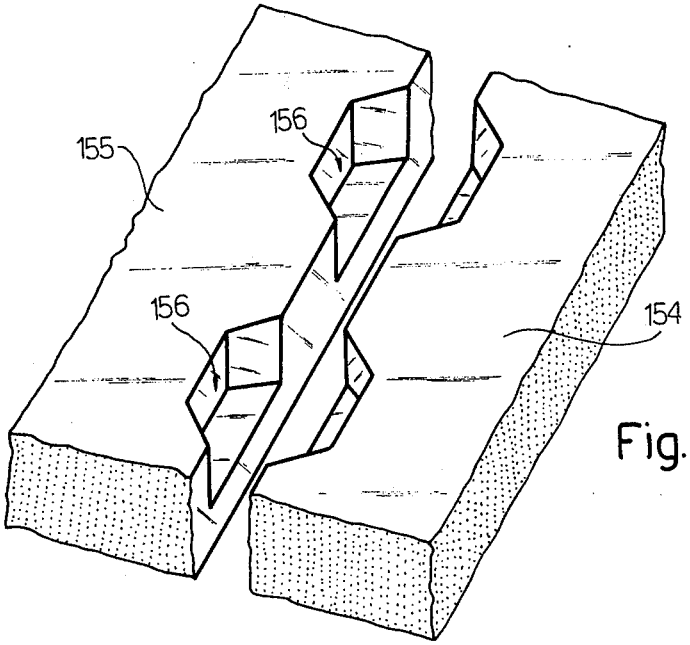
Fig.39
Fig.41
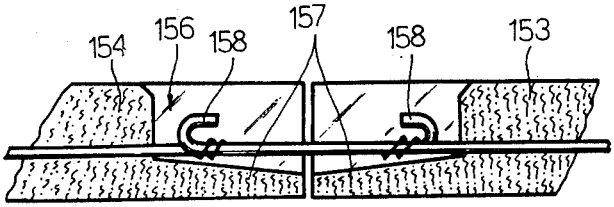

THREE-DIMENSIONAL COMPONENTAL MODULE AT "T" MODIFIED FOR THE INDUSTRIAL PREFORMATION OF BUILDINGS

This is a continuation, of application Ser. No. 892,765, filed Apr. 3, 1978 now abandoned.

BACKGROUND OF THE INVENTION

The present invention has as its object a three-dimensional componental module at "T" modified for the industrial preformation of buildings.

In present-day research in the field of industrial building, the attention of planners and producers is directed to prefabricated systems which permit the maximum constructive rationalization, united to a productivity of contained costs.

To obtain high industrial results in practice it is necessary to prepare the various prefabricated elements in a special workshop and thereafter to assemble them at the building site, obtaining building structures whose property, given the constitutive scheme and method of construction, provide notably advantageous costs in comparison to other prefabricated techniques and traditional methods.

The problems are therefore various and complex which are presented in the research of an optimum solution which at the same time is particularly economic, versatile and simple.

Among these problems it will be sufficient to mention a few which seem today to be of the most difficult to resolve.

The first problem concerns the choice and shape of a minimum number of standardized elements with which it is possible to realize variously composed buildings in a variety of both internal and external sizes.

A second problem, closely tied to the first, is that of producing these elements in specially-fitted workshops utilizing industrial techniques of mass production; and also to this last problem an another is directly connected: given the conformation of production workshops, they are constituted by fixed machinery and from this is born the problem of transporting the ready prefabricated elements to the building site by road vehicles which have load and size limitations.

In this operational phase of transportation the stresses due to the condition of the roads and to the mechanical means cannot be overlooked.

The technical aim of the present invention proposes to resolve the preparation of a modular prefabricated structure which can by itself or with the aid of complementary elements, permit the construction of buildings of one or more floors, and which allows such freedom of design as to permit plans sufficiently free to allow freedom to creative expression by the designer.

The solution of this technical aim must be seen in the context of an industrial production and therefore repetitive at low cost of various prefabricated elements.

From that which is proposed the primary object for the present invention is to reduce to a minimum the number of base elements, and to produce a basic module which will be called "base" from which other elements can be easily and directly derived for the composition of buildings of one or more floors with the maximum flexibility of design.

And not the last aim coming from the technical plan proposed is that of realizing all of these elements with a mould installation, bringing into use the economy and industrialism of the product.

SUMMARY OF THE INVENTION

The technical purpose and its consequent scopes are possible by means of a three-dimensional componental module in the shape of a "T" modified for industrial preformation of buildings characterized by the fact of comprehending a fundamental module in the shape of a dissymetrical "T" composed of a vertical reinforced concrete slab (principal ribbing) sustaining with a fixed joint a horizontal slab presenting on the upper surface some secondary ribs in its partial or complete extension; this fundamental module developing in a longitudinal sense still being characterized by the fact that both the horizontal and vertical slabs derived from it by subtraction of the parts contain all the necessary and sufficient elements for the realization of the most varied buildings of distributive physionomy, means being foreseen for the realization on the aforesaid horizontal slab and on the heads of other elements of areas of casting in loco —ortbeton— conveniently reinforced, enough so as to realize a connection-beam between the various elements, realizing in such a way the necessary static function of the module.

BRIEF DESCRIPTION OF THE DRAWINGS

More characteristics and advantages of the invention come into play by the detailed description of the module which for its characteristic form we shall call "module base Γ" (gamma-capital letter), of some other elements derived from it, of some complementary elements and of typical composite forms.

The description and illustrations are given indicatively and must not be considered limitative of the inventive concept.

Figure 1:
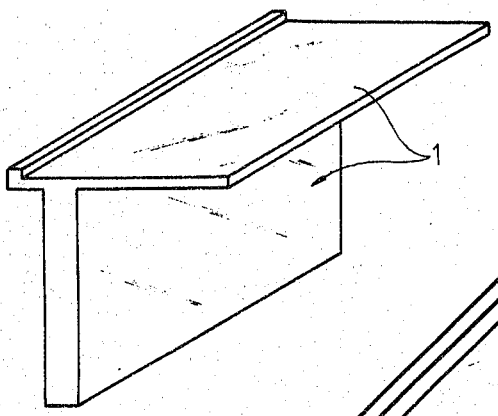
Figure 2:
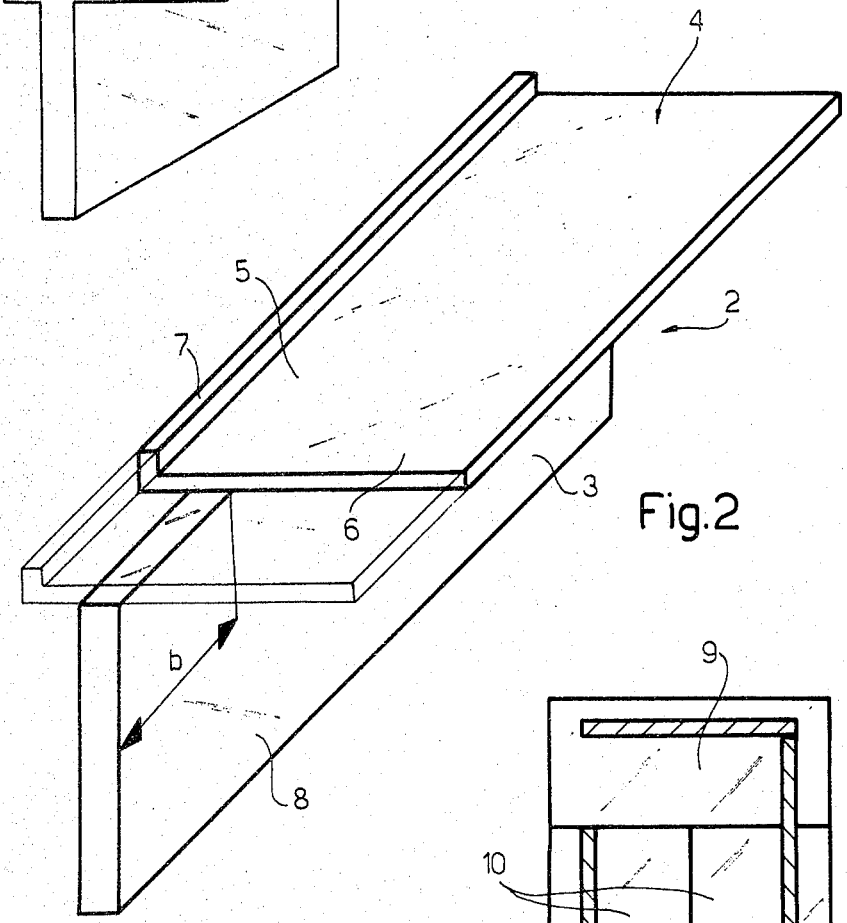
Figure 3:
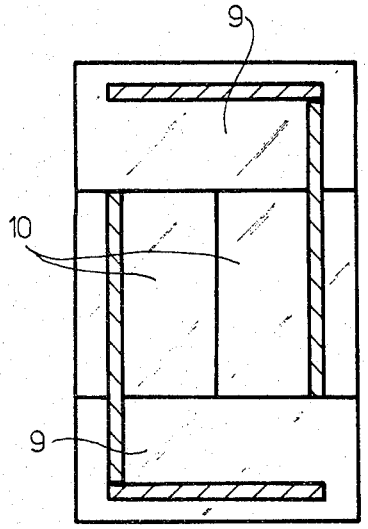
Figure 4:
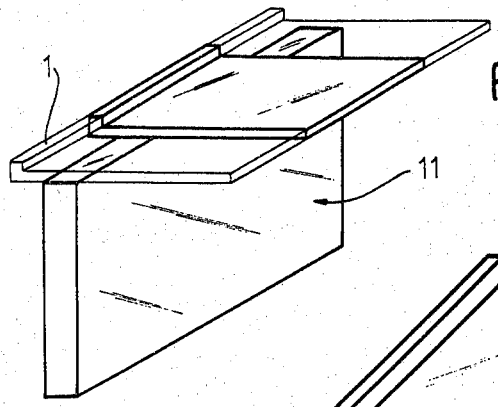
Figure 5:
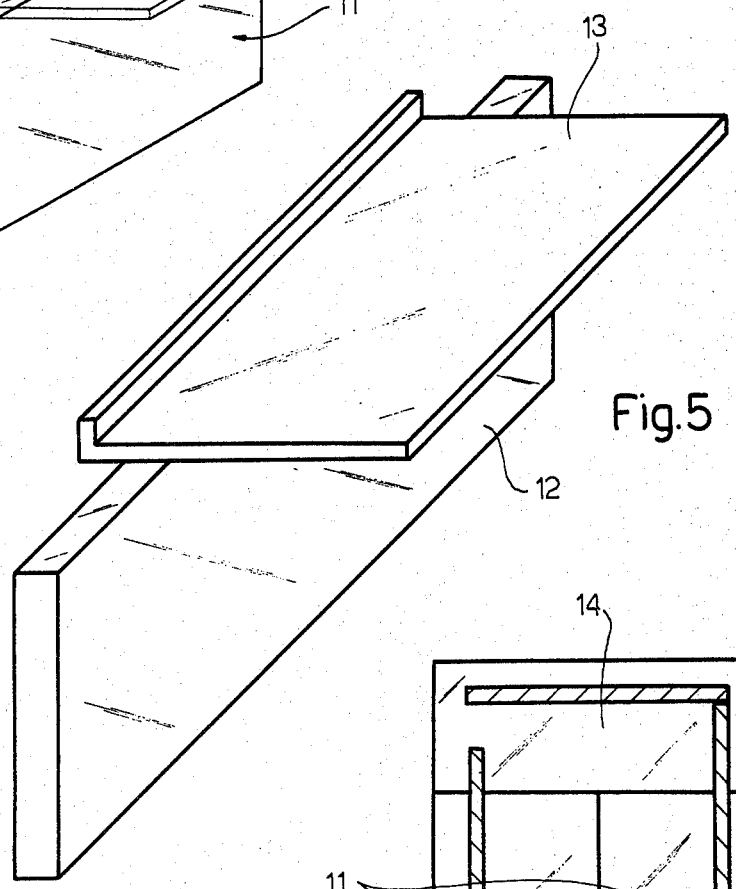
Figure 6:
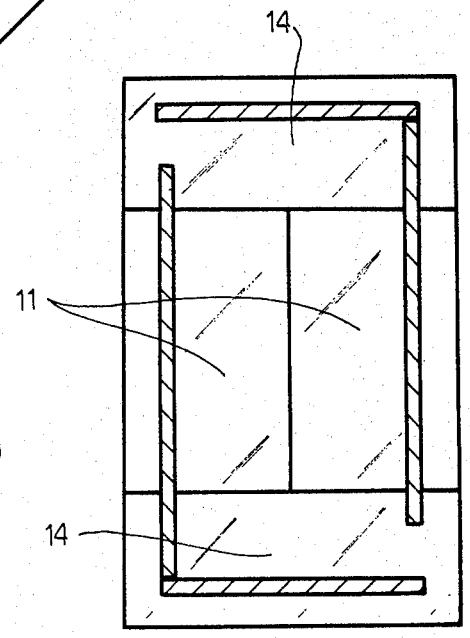
Figure 7:
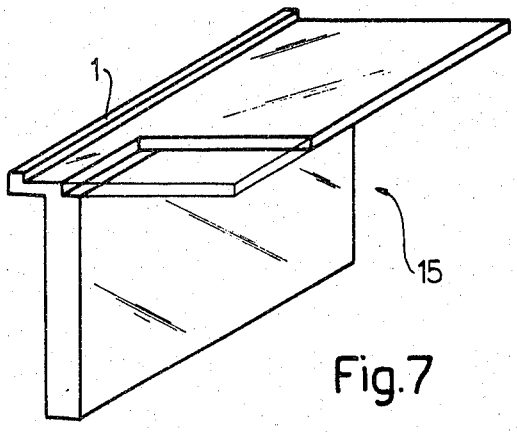

For that which regards the tables of design included:

FIG. 1 represents a base module derived from dissymetrical T that in this description we shall call "base module Γ";

FIG. 2 represents in light line the base module Γ from which a second element $\Gamma_a$ is derived with a jutting out vertical slab on one side in respect to the horizontal slab;

FIG. 3 is a detail section on a horizontal plane, and looking upward, of an assembly of the elements of FIGS. 1 and 2;

FIG. 4 represents by a light line the base element Γ from which a third element $\Gamma_b$ is derived with a jutting out vertical slab on both sides in respect to the horizontal slab;

FIG. 5 represents the $\Gamma_b$ element;

FIG. 6 represents an example of compositeness of two $\Gamma_b$ elements with two Γ elements;

FIG. 7 represents in light line the base element Γ from which the fourth element $\Gamma_c$ is derived with the horizontal slab partially interrupted.

Figure 8:
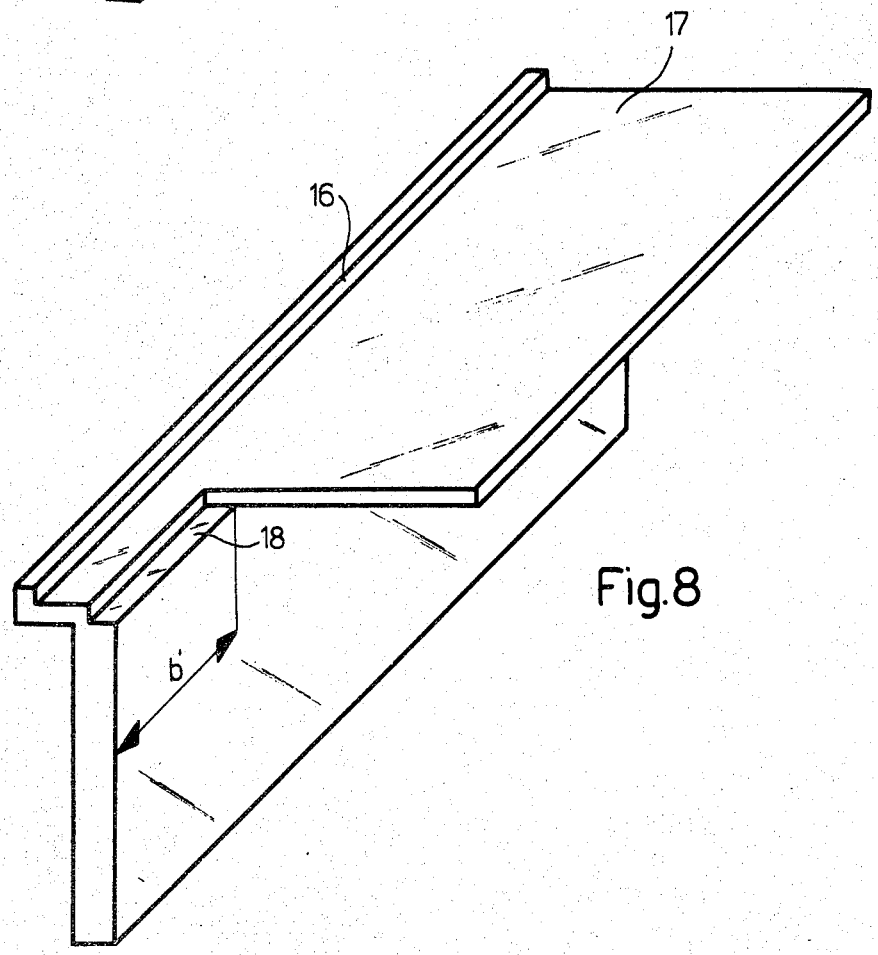
Figure 9:
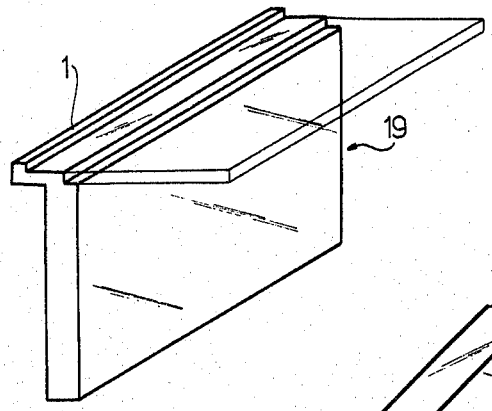
Figure 10:
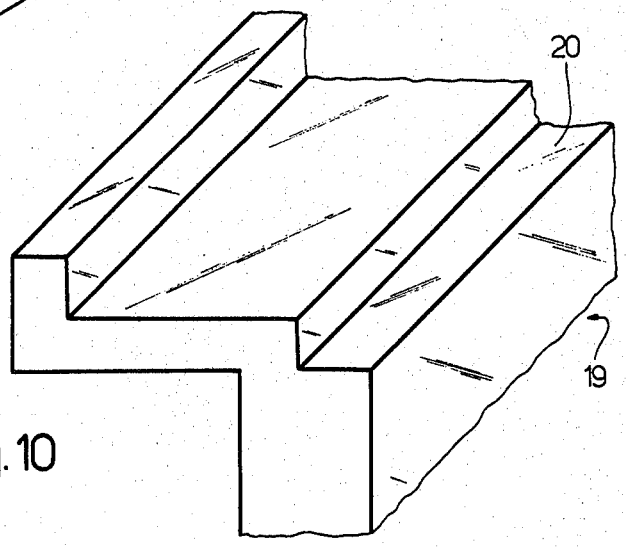
Figure 11:
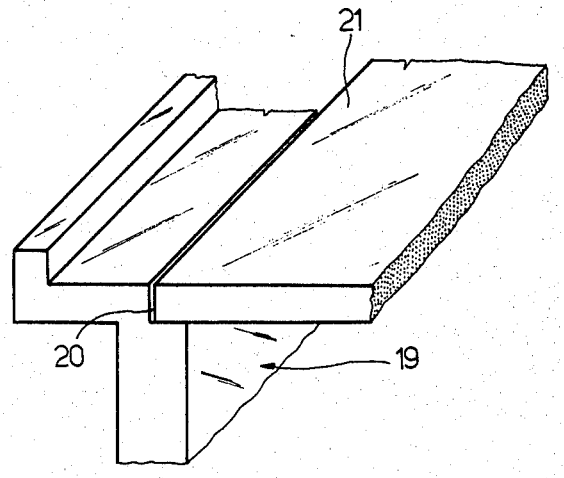
Figure 12:
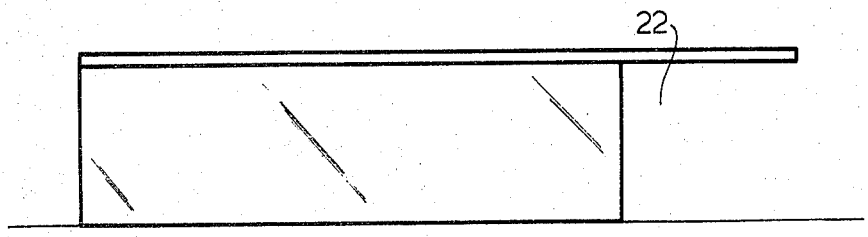
Figure 13:
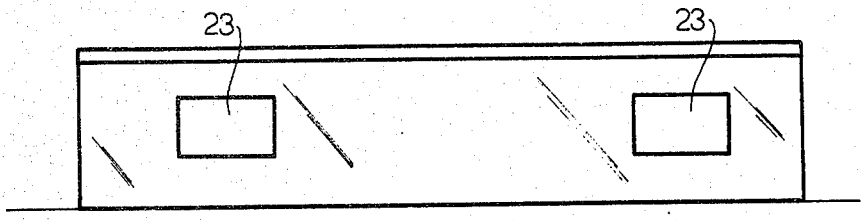
Figure 14:
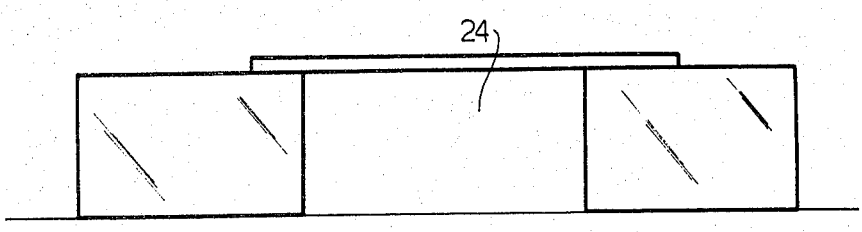
Figure 15:
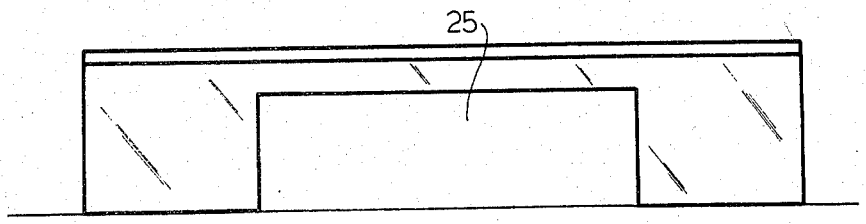
Figure 16:
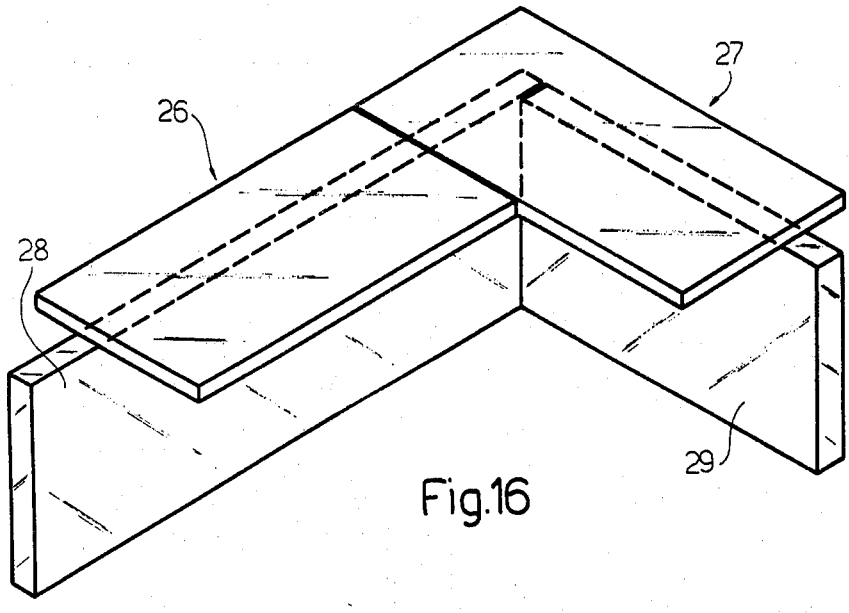
Figure 17:
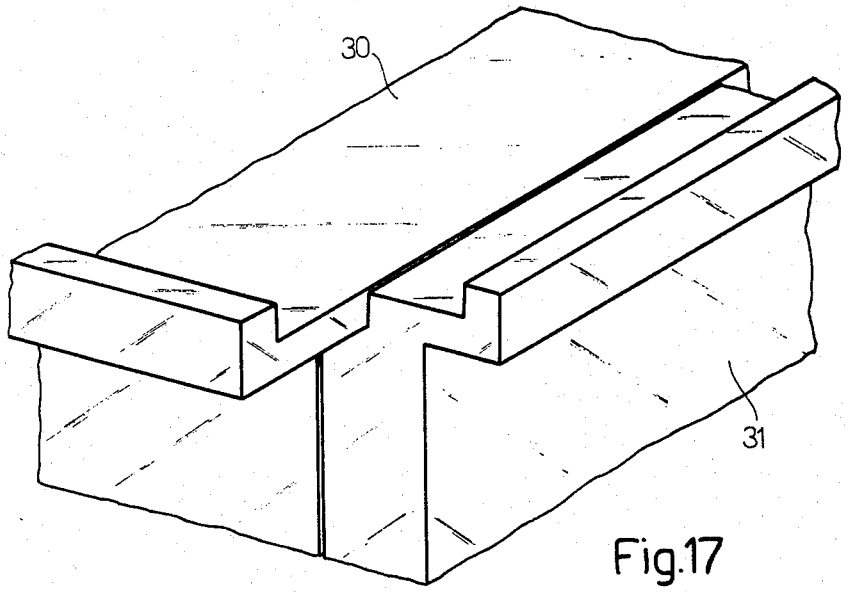
Figure 18:
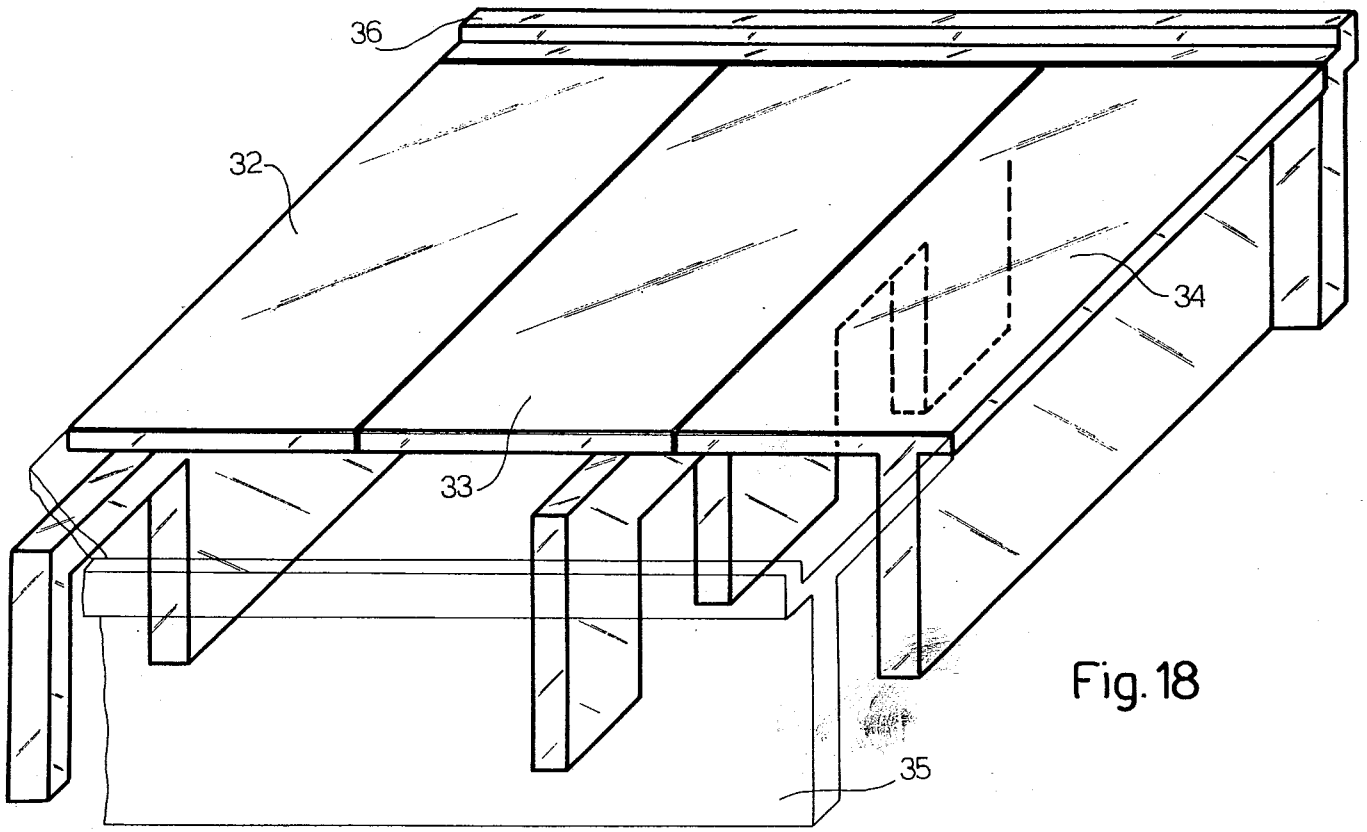

FIG. 8 represents element $\Gamma_c$;

FIG. 9 represents in light line the base element Γ from which an element $\Gamma_d$ is derived with the function of a wall;

FIGS. 10–11 represent a $\Gamma_d$ element alone and in union with the horizontal slab of another element;

FIGS. 12–13–14–15 represent other elements derived from the base element Γ by subtraction of the parts in the vertical slab;

FIG. 16 represents the formation of an angle obtained with an element $\Gamma_b$ and an element $\Gamma_a$;

FIG. 17 represents the formation of an angle obtained with a base element Γ and an element $\Gamma_d$;

FIG. 18 represents a typical assembly obtained with the use of various elements;

(The figures from 19 to 40 which now follow represent other elements derived as well as means of joining; and in the description, the numeration is taken from a base 100).

Figure 19:
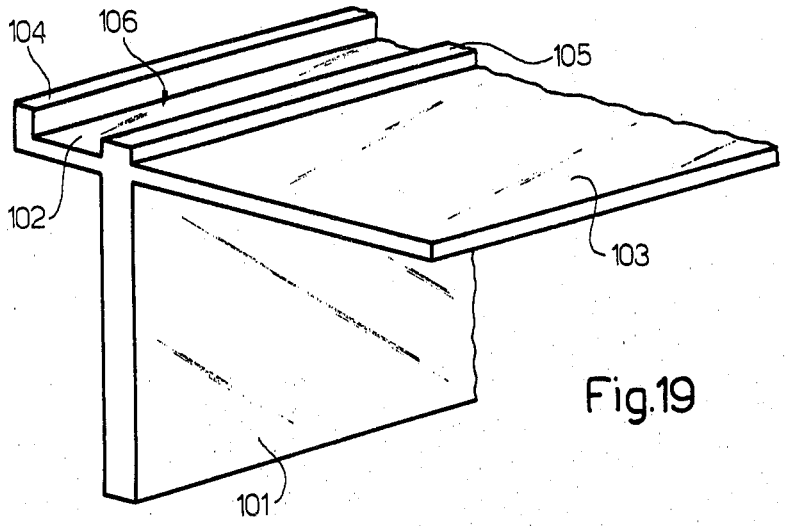
Figure 20:
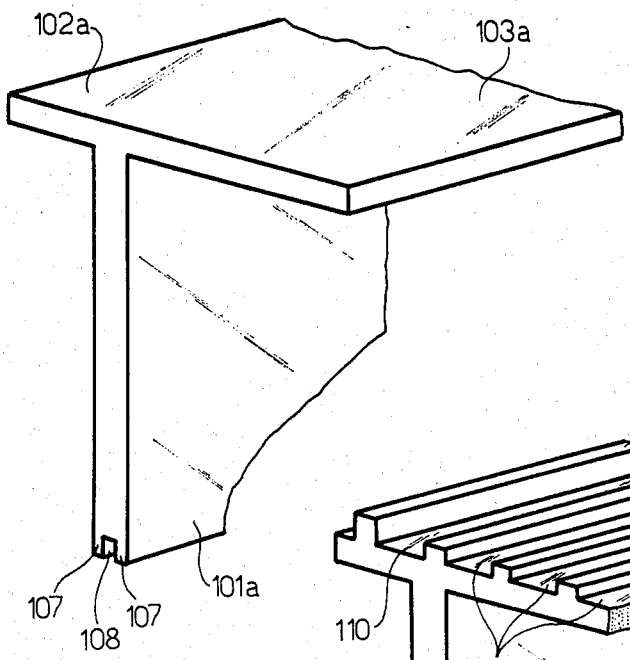
Figure 21:
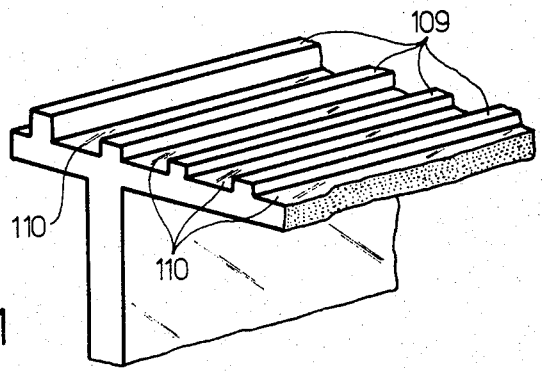
Figure 26:
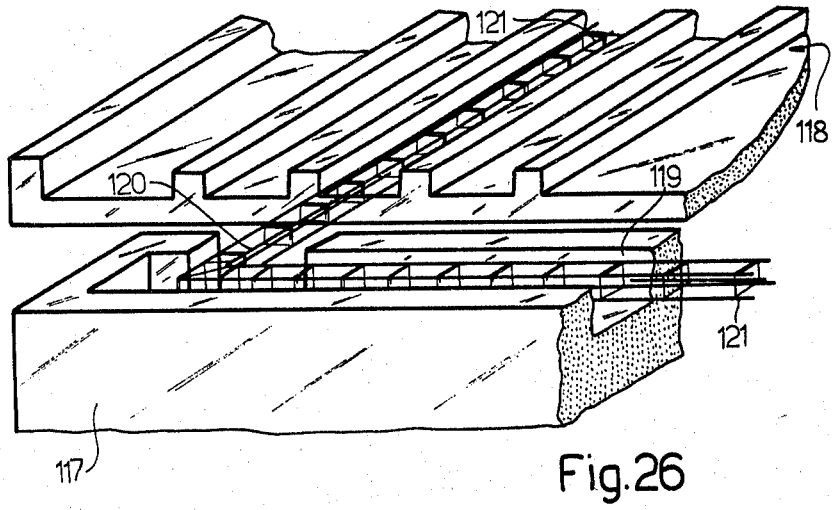
Figure 31:
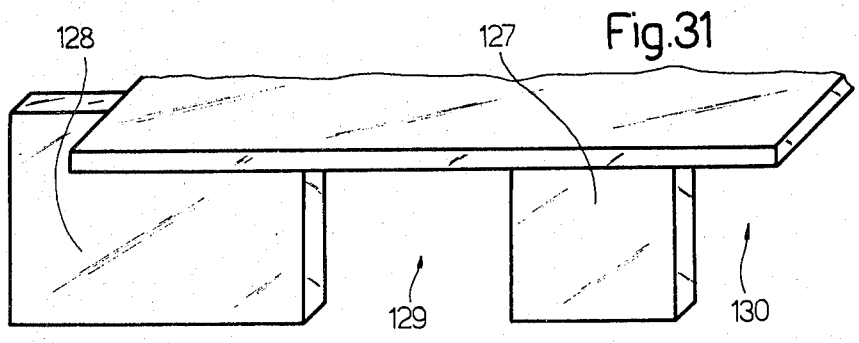
Figure 32:
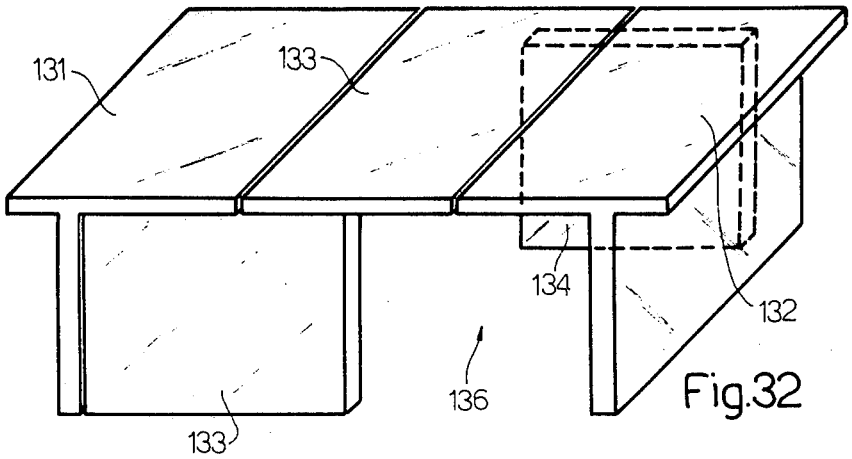
Figure 33:
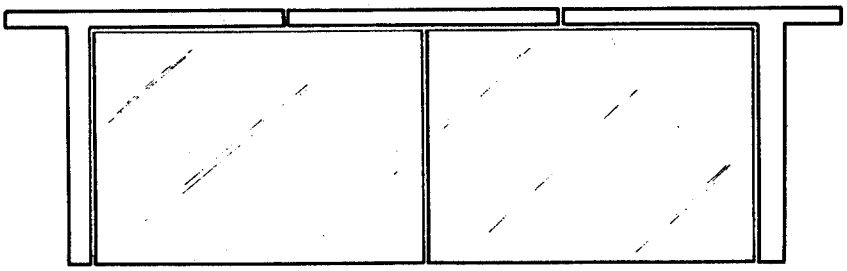
Figure 34:
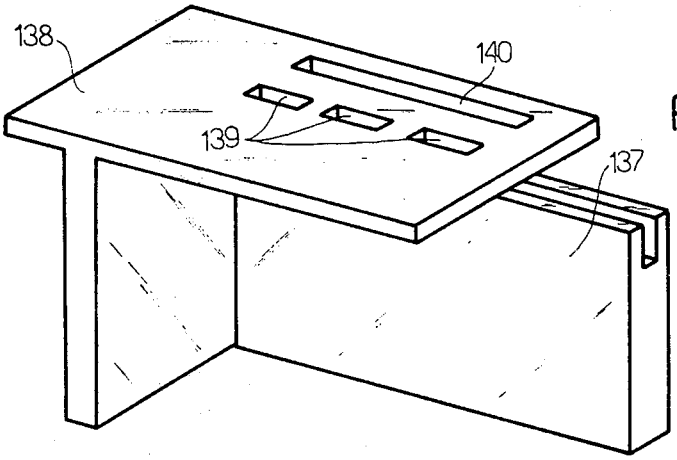
Figure 35:
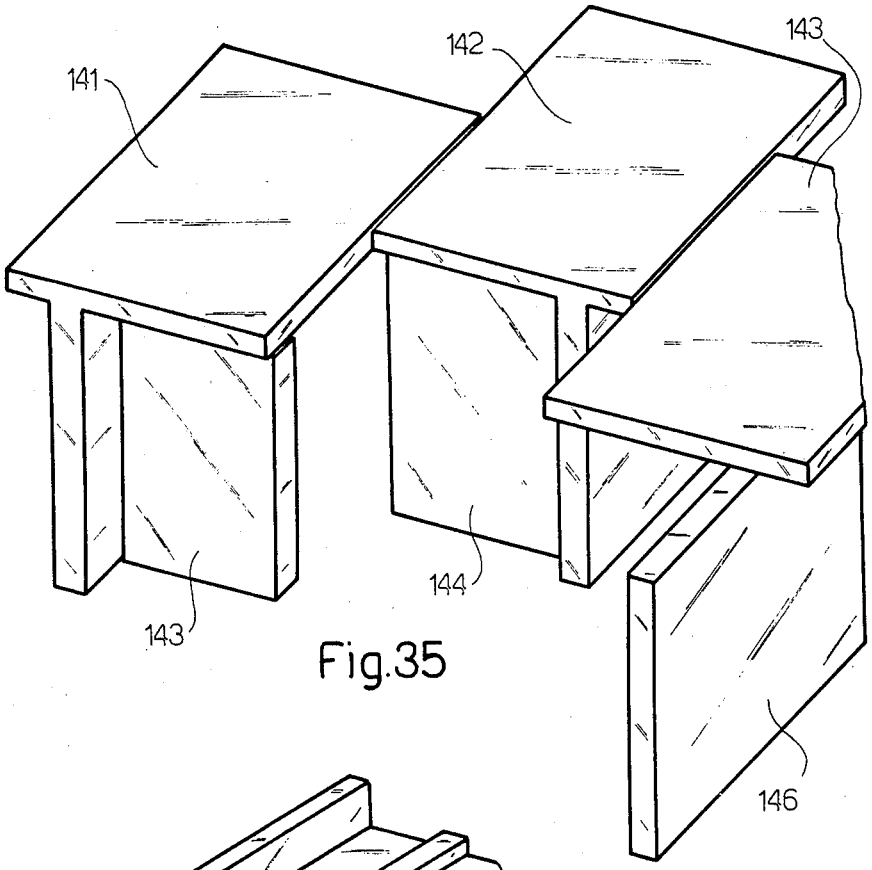
Figure 36:
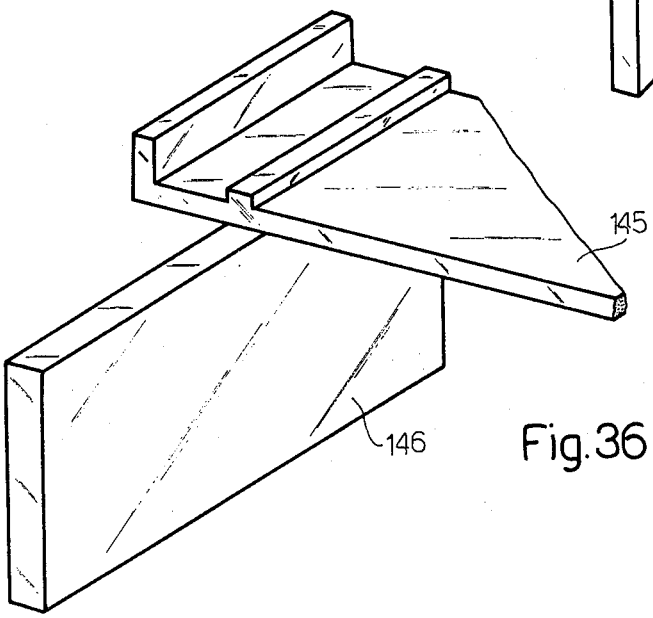
Figure 37:
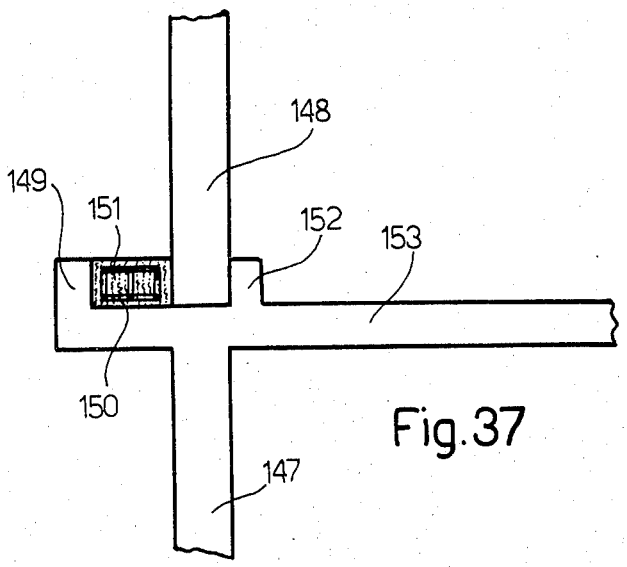
Figure 38:
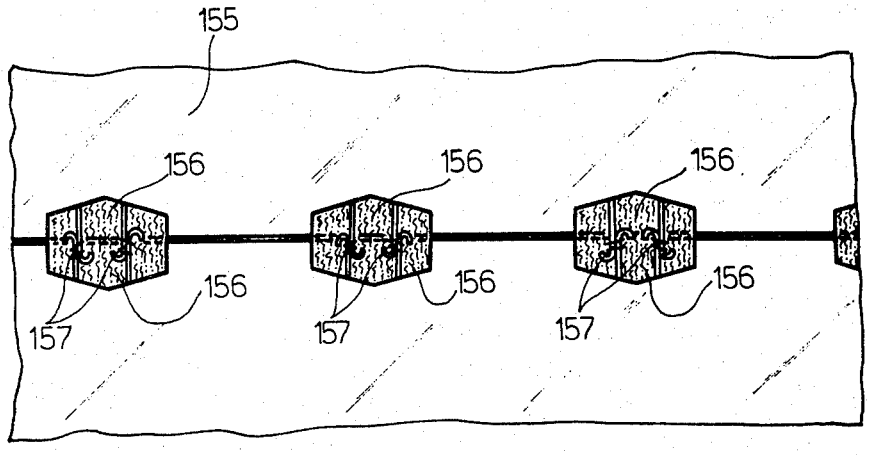
Figure 42:
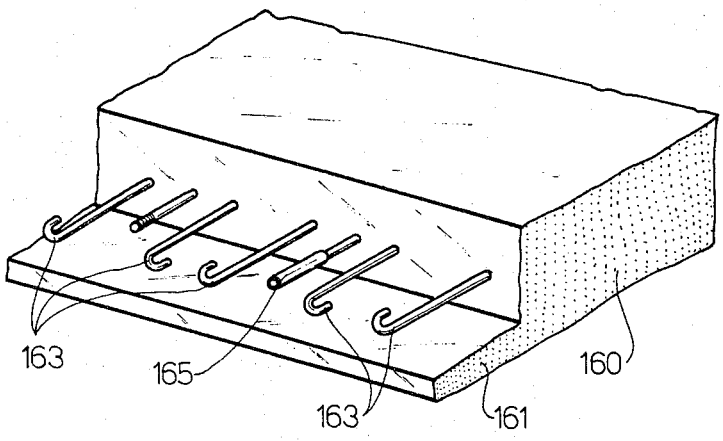
Figure 43:
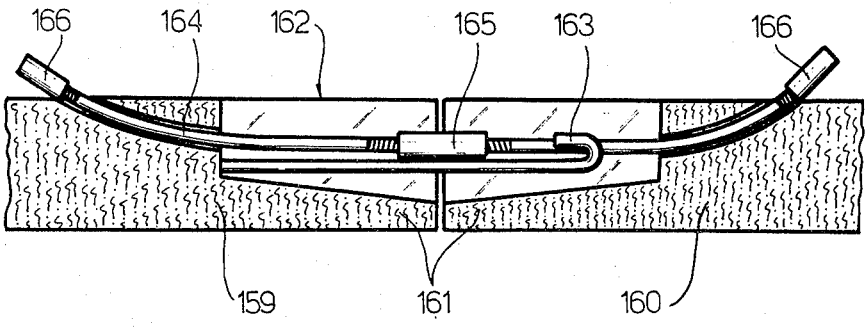
Figure 44:
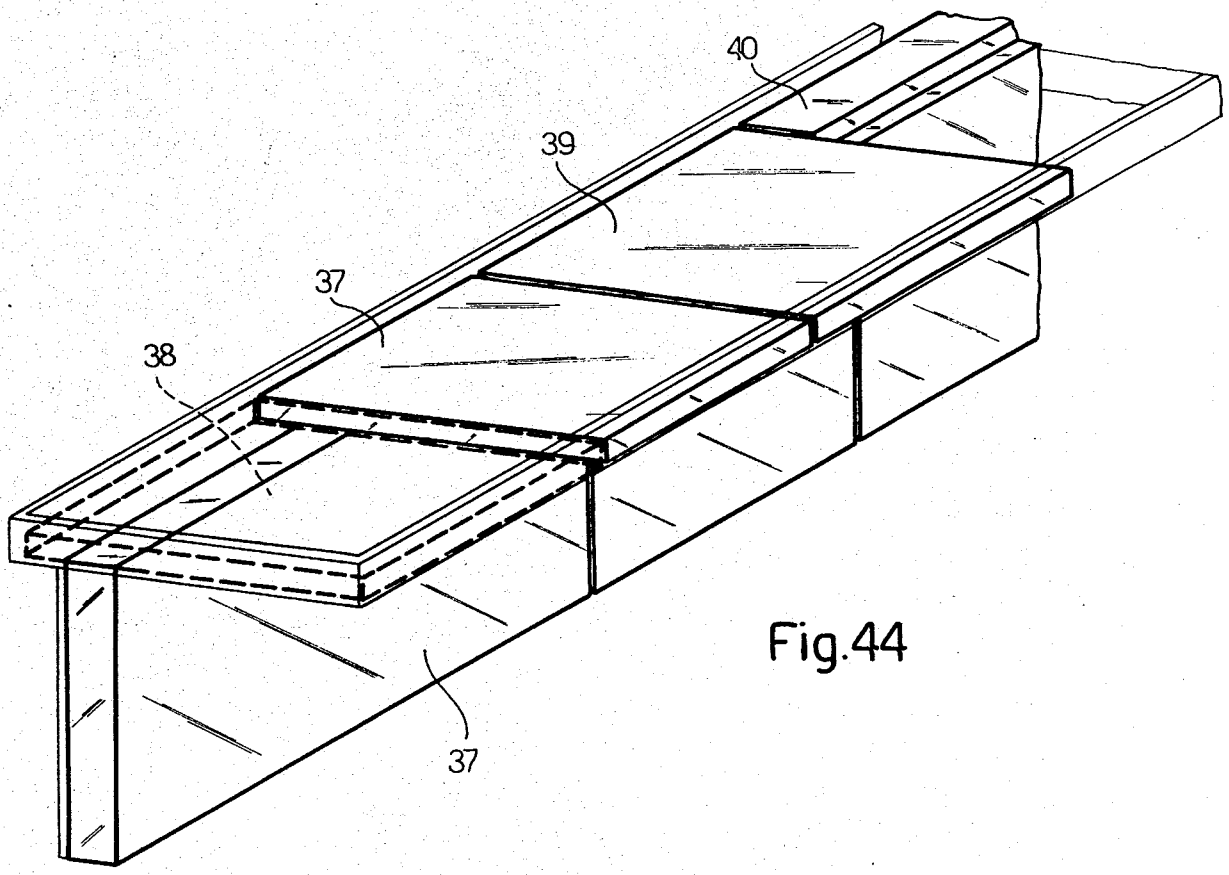

FIGS. 19–20–21 represent further variants of base element Γ;

FIG. 22 represents the association of a base element Γ with an element which we shall call "wall-beam" with an uneven-edged head duct (groove);

FIG. 23 represents an intermediate section of that which represents FIG. 22;

FIG. 24 represents in section a wall-beam with an even-edged duct united to a base module Γ;

FIG. 25 represents a front view of a variant of the said wall-beam;

FIG. 26 represents a front view of a form of execution of a connection-beam;

FIGS. 27–28–29–30 represent front views of the union of Γ elements and of wall-beams;

FIG. 31 represents a further Γ element;

FIGS. 32–33 represent two views, one frontal and one lateral, of the composition of Γ elements, of wall-beams and flat slabs;

FIG. 34 represents the front view of a Γ element and a wall-beam showing the openings of localized or continuous casting;

FIG. 35 represents the front view of another example of compositeness of the said prefabricated elements;

FIG. 36 represents another element derived from element Γ;

FIG. 37 represents the lateral view of the overlaying of two Γ base elements for the realization of multi-storeyed buildings;

FIGS. 38–39–40 and 41 represent some views of a first method of the joining of the head of the horizontal slab of the said elements Γ;

FIG. 42 and 43 represent a second method of joining of the horizontal slab of the Γ elements;

FIG. 44 represents the realization of more diverse elements by means of a single mould of great length.

DETAILED DESCRIPTION OF THE INVENTION

With reference to the cited figures with 1 is indicated the module Γ from which by subtraction of the parts both in the horizontal and vertical slabs, all the necessary and sufficient elements are taken for the realization of one-storeyed and multi-storeyed buildings, some of which will now be described.

It was necessary to give importance to this element calling it "base element Γ", as it ideally unifies every other element and for this reason it will be possible, as will be seen from the succeeding, to carry out production with only one mould of casting in a longitudinal line, with an industrial technique analogous to that utilized for the production of beams in general.

From this base element Γ indicated by 1 a second element is derived $\Gamma_a$ indicated by 2 and obtained by subtracting a part of the horizontal slab and therefore composed by a vertical slab 3 and by a horizontal slab 4 constituted by two dissymmetrical wings 5 and 6. Of these, wing 5 of minor transverse dimensions presents a perimetrical ribbing 7 whose height will be conveniently equal to the final thickness obtained with a casting in loco.

The fundamental characteristics of this element $\Gamma_a$ is that the vertical slab 3 juts out beyond the horizontal slab 4 for a length that has been indicated by "b" FIG. 2.

On this jutting element 8 the wing of another element will rest; for instance the horizontal wing of base element 1 may rest upon the extended end portion 8 of vertical slab 3 and therefore the "b" dimension will be conveniently equal or less then the length of the wing jutting out.

In FIG. 3 the example of this way of composing a structure is shown: the view on the plan shows two base elements Γ indicated by 9, composed by two $\Gamma_a$ elements indicated by 10.

In FIG. 4 with a light line the base element $\Gamma_1$ is still indicated from which by subtraction of two portions of the horizontal slab a new element $\Gamma_b$ 11 is formed.

The characteristic of this element $\Gamma_b$ indicated by 11 is that of having the vertical slab 12 which juts out at both ends in respect to the horizontal slab 13, thereby providing two appendices of support of opportune length on which the wing of the base element 1 of FIG. 1 will rest. An example of such an arrangement is seen in FIG. 6—of other elements 14 as example of base type Γ.

In FIG. 7, always based on the base element $\Gamma_1$, by subtraction of a portion of the horizontal slab another element is obtained $\Gamma_c$ 15 with the following characteristics: for a certain length the horizontal slab has two adjoining wings 16 and 17 which for the remaining length indicated by "$b^1$", a portion of the wing 17 is omitted, entirely to an intermediate point of the vertical slab obtaining a step 18 on which the horizontal slab of another element will rest.

If, instead of omitting only the length "$b^1$" of the horizontal wing 17, the entire length of the horizontal slab is omitted, as seen in FIG. 9, a new element called $\Gamma_d$ is obtained and indicated by 19.

As clearly as is seen in FIGS. 10 and 11 the upright slab of element 19 may define a true self-carrying closing wall presenting in the upper part a continuous step 20 which extends for the entire length of the element and on which the horizontal slab 21 of another element will rest.

Up to now elements have been obtained by the subtraction of parts in the horizontal slab of the base element $\Gamma_1$ while the FIGS. 12–13–14–15 show four examples of elements obtained by subtraction of parts in the vertical slab.

In such a way openings 22 at the ends of the element can be formed; window-openings 23 intermediate to the vertical slab, openings at full height 24 or at reduced height as at 25 which will constitute internal spaces necessary to access throughout the premises.

In FIG. 16 instead the formation of an angle of a building is illustrated utilizing an element $\Gamma_b$ 26 and an element $\Gamma_a$ 27.

The projecting ends 28 and 29 of the vertical slabs that further extend from elements 26 and 27 that form the angle, constitute the rests for the continuation of the structure without limitations of development.

In FIG. 17 the angle is formed instead utilizing a base element F 30 united to a $\Gamma_d$ 31 element (of FIGS. 9–10) which acts as a closing wall.

In FIG. 18 as an example a structure is illustrated which is composed utilizing two elements $\Gamma_a$ 32 and 33

(of FIG. 2) arranged parallelly and with horizontal slab in contraposition in order to create a larger room, further supported parallely to a first base element Γ 34 (of FIG. 1). The three elements are closed by a second base element Γ 35 arranged transversely, to the other direction and the structure is closed by an element $\Gamma_d$ 36 or by a wall.

From this view, one notes the extreme versatility of the elements and the possibility to compose free plans, given that the dimensions both in length of the vertical slabs and of the width of the horizontal slabs can be chosen, with the only exception of the limits of transport.

Further amplifying the gamma of the elements that can be derived from base element Γ, in FIG. 19 an element substantially constituted by a vertical slab 101 and two horizontal wings 102 and 103 of different width. More in particular the wing 102 is of transverse dimensions reduced and presents a longitudinal secondary upright rib 104 along the free edge.

A second longitudinal secondary upright rib 105 parallel to the first and practically localized in vertical alignment with the said vertical slab 101, the ribs 104, 105 define a perimetrical duct or channel 106 that will preferably confine a continuous reinforcement, of eventual precompressed cables and of a casted beam which will later be described.

In FIG. 20 an element is shown that presents a few variants in respect to that already described.

In fact the two wings $\mathbf{102}_a$ and $\mathbf{103}_a$, do not present any projection-rib on the upper surface: in this case the projection-rib can conveniently be realized in loco according to the necessity, or they can be constituted, for example, by elements in the shape of a U upside down with the double advantage of realizing moulds at a loss for the seating of reinforcement, and internally room-ducts for the passage of various services.

The base of the principal vertical slab $\mathbf{101}_a$, presents in this case two parallel rests or ribs 107, separated by a duct or recess 108. This can be convenient for the superimposition of the Γ elements centralizing and positioning them.

In FIG. 21 one sees a further variant of base module Γ. The wings of this element present a plurality of upstanding ribbing-projections 109 that can extend partially or through the complete length of the wings.

These ribbing-projections 109 give origin to an analogous plurality of ducts recesses 110, which can constitute both the seating place of reinforcement, and seatings of passage of service installations.

FIG. 22 represents an example of assemblage of a Γ element with a first execution form of wall-beam.

The latter is composed by a vertical slab-form 111, that at its height presents two projection-ribs 112 and 113, rib 112 being lowered with respect to rib 113 that form between them a longitudinal seat or recess 114.

The wing $\mathbf{103}_b$, of element Γ surmounts the lowered projection-rib 112 and there rests as can more clearly be seen in FIG. 23.

The longitudinal seating or recess 114 will include a reinforcement steel cage and a joining casting (beam) of the structure.

In the case of not wanting to surmount wing $\mathbf{103}_c$ (FIG. 24), the wall-beam $\mathbf{111}_c$ will have two projection-ribs $\mathbf{112}_c$ and $\mathbf{113}_c$ of equal dimensions still presenting a longitudinal seat or recess $\mathbf{114}_c$.

In FIG. 25 a further variant of the wall-beam is represented. In this case the zone presenting the seating or recess $\mathbf{114}_d$ is prolonged in relief for an interval 115 of length equal to the lesser wing of the element Γ to which it will be put side by side. In this way foreseeing a lateral opening 116, it is possible to carry the beam perimetrically in respect to the element Γ.

In FIG. 26 the preparation of a connection-casting is represented with a wall-beam of the type illustrated in Fig. 24.

The wall-beam, here indicated by 117, is put beside an element Γ 118, presenting a head duct 119 with lateral opening 120; therefore a metalic cage reinforcement 121 is situated which will be successively sunk in a casting in loco—ortbeton—of joining.

Figure 27:
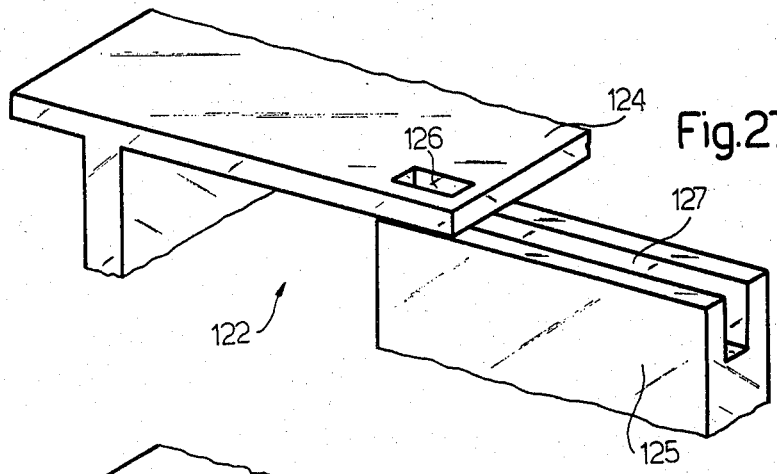
Figure 28:
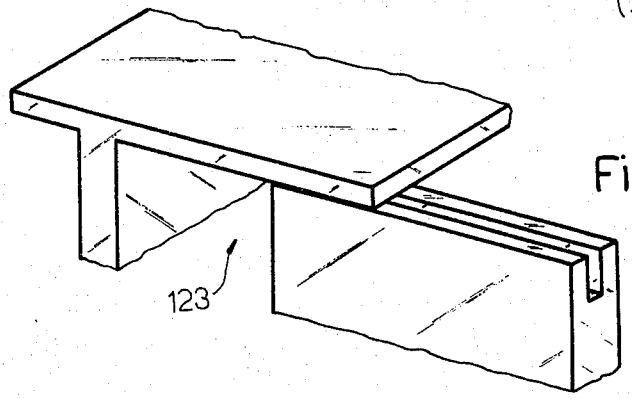
Figure 29:
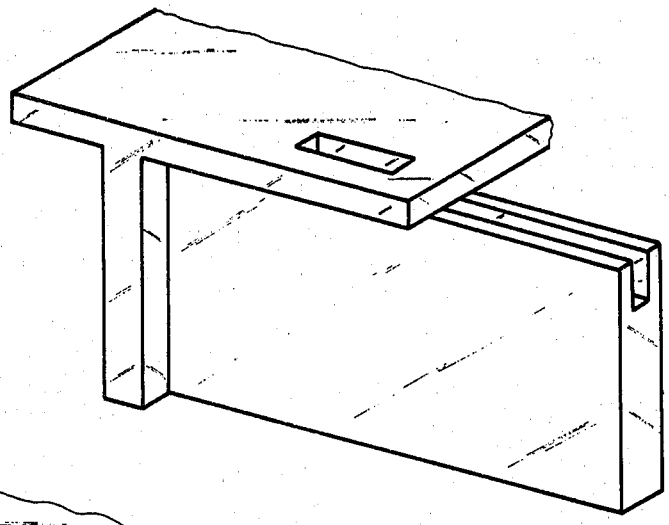
Figure 30:
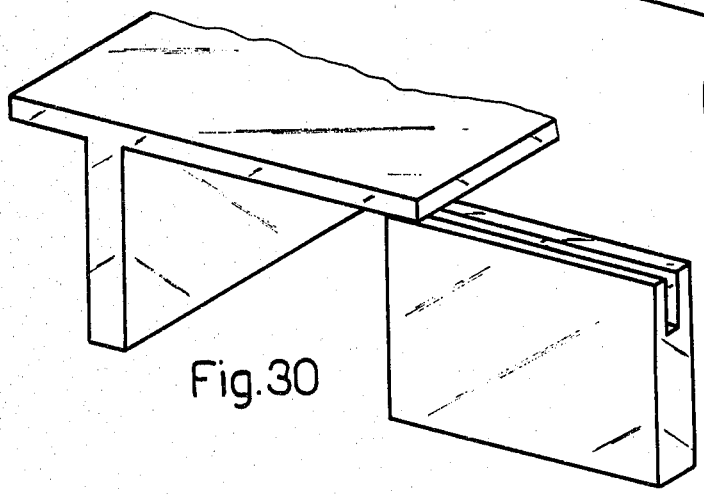

In FIGS. 27 and 28 another two methods of association of two fundamental elements are illustrated, realized in the intention of obtaining passages indicated by 122 and 123.

In the first case then the wing 124 completely surmounts the wall 125 and in order to realize the joning-casting are foreseen openings of type 126 localized in correspondence of the duct 127 of the wall 125. The same dispositions are still illustrated in FIGS. 29 and 30.

FIG. 31 shows instead an element Γ where the principal ribbing or vertical slab is subdivided into two parts 127 and 128 which leave two passages free 129 and 130.

FIG. 32 exemplifies the joining of two elements Γ 131 and 132, of two walls 133 and 134 and of a flat plate 135.

In this case the two walls 133 and 134 alternately jut out in respect to elements Γ functioning as rests for plate 135, likewise obtaining openings of type 136. In the case that there might not be openings, the structure will be of the type indicated in FIG. 33.

The wall-beam 137 —FIG. 34— can function also as divider in respect to an element Γ 138, and then localized openings 139 will be foreseen, or continue to permit the joining castings.

In FIG. 35 the composition of two base elements Γ 141 and 142 is shown, completed by two wall-beams 143 and 144 disposed to sustain said elements at Γ.

Other than these base elements another one is present comprehending an upper horizontal wing —145— associated to a vertical ribbing or slab —146— partially jutting out beyond the development of the same wing to provide a rest for other structures.

FIG. 37 exemplifies the superimposition of two elements Γ: the two principal ribbings or vertical slabs —147— of the lower element and —148— the upper one are aligned between each other; between the base of said ribbing 148 and the perimetrical projection-rib —149— a longitudinal duct or channel —150— is formed where a joining casting is created at —151— and reinforced to constitute a beam.

The vertical ribbing or slab —148— finds rest for the alignment on a longitudinal projection —152— present on the horizontal wing 153 of the lower Γ element.

This is one of the possible methods of superimposition which can therefore be different according to the conformation of the surfaces of the wings and the ribbings.

To join by the head the horizontal wings of two put side by side elements Γ, indicated by figures 38–39–40—41 with numbers 154–155, there are foreseen in a first form of execution more open seatings of casting 156 provided in the same body of the wings, presenting on a lower level a septum of base 157.

Putting beside the two elements 154–155 moulds at loss are formed with a bottom already predisposed in which steel reinforcement 158 is present coming out from the elements Γ.

A casting followed in the work will solidly connect the heads realizing the necessary static continuity of the structure.

In a second exemplifying form of connection FIGS. 42, 43, the elements Γ 159 and 160 present along the edge a lowered step 148 which at the moment of putting beside will realize a continuous seating 162 in which steel reinforcement 163 will come out. To augment the stability of connection two precompressed cables 164 are foreseen inserted with sheath connected between them in the zone of casting by means of a screw-sleeve 165 with a dual effect.

The casting being executed, after the desired time the putting under tension of the cables 164 will be accomplished from sleeves 165 where elements 159 and 160 come out.

All these elements illustrated are provided in concrete with the possibility of good characteristics of thermic and acoustic insulation.

Other than these elements there is another not indicated which is consequently evident and that is a flat floor plate that can be interplaced between two elements Γ to amplify the free internal length of the rooms.

Retracing the concept of base element Γ and its derivitives one notes how all these elements can be produced in one only mould (see the plan indicated in FIG. 44) developed longitudinally of great length with industrial techniques analogous to those used for the realization of beams. The parts to "take away" from base element Γ will be obtained with septa or conveniently separated only to obtain complementary elements.

Such an example in FIG. 44 which shows an element $\Gamma_a$37, where the part to take away is only separated to obtain a portion of floor plate (slab) 38; there follows a base element Γ 39 and an element $\Gamma_d$ 40.

Obviously these examples of disposition which have been given with development of the plan can be repeated for multi-storeyed buildings, where the disposition of the elements on various floors can be homotetic or not, according to the plans and the premises that are desired.

The reconductability of all these elements necessary and sufficient for the construction of buildings to an one-based element Γ gives the possibility of maximum industrialization in the production of the same elements reaching the primary scope that the inventor has prefixed.

The dimensional limits and the materials, not being binding theoretically, will grow out of the problems of an economic transport both for that which regards dimensions and weights.

With the tree-dimensional elements of the present invention which have been described hereinabove, not only multi-storeyed structures of any predetermined configuration are realized, but also, for each floor, a rigid box-like structure is obtained in which the two fundamental parts (i.e. floor plates and walls) of the structure anhance the resistance when external actions, such as static loads, wind pressure and seismic actions, are exerted onto the structure itself.

This advantageous behaviour of the structure, which renders it particularly suitable to be utilized in seismic zones and for multi-storeyed buildings, derives from the fact that the form and structure of the various elements are such as to allow a connection between them by which the floor plates result in being rigidly jointed with the carrying walls, so that spatial structures are originated which are substantially monolithic and whose parts are able to efficiently interact with each other; in other words, even if the structure is formed by a plurality of elements, each of these is, statically and constructionally, so intimately integrated in the structure that it loses its individuality as a single element of the structure whose behaviour can only be evaluated as a whole.

The rigid and efficient connection between the structure elements which is realized in correspondence of each joint derives not only from the form of the base module, but also from the particular shape which has been contrived for each element obtained by subtraction of parts of the module itself. In fact, in connecting two elements in each joint, not only a junction of the two adjacent vertical edges of the respective vertical plates is realized, but a true superimposition of a portion of a wing of one element upon a corresponding portion of vertical plate of the adjacent element is obtained. With regard to this, see the connections obtained in this way in the joints shown in FIGS. 3, 6, 11, 16, 17, 22; in each of these joints the rigidity of the connection derives mostly from the superimposition relationship of one of the wings 5 and 6 with the vertical plate 3 of another element. A connection having the same characteristics of rigidity and monolithicality is obtained also when an element Γ is associated with a wall-beam 111 (FIG. 22) of the type of those described with reference to Figures from 22 to 35; in fact, also in this case there is still a superimposition relationship of a wing of one element with the uper edge of the vertical plate of the element associated with it.

What I claim is:

1. A building enclosing room spaces comprising a multiplicity of molded precast concrete building modules defining the upright walls and the horizontal overhead ceilings of the room spaces, each of said building modules including an elongate vertical slab and an elongate horizontal slab, the vertical and horizontal slabs being cast integrally in one piece and being rigid with respect to each other, the horizontal slabs having first and second longitudinal side edges, the vertical slab of each module having an upper portion upon which the horizontal slab is supported, and the vertical slab being disposed between the first and second edges of the horizontal slab and significantly closer to the first edge of the horizontal slab than to the second edge thereof whereby to define first and second horizontal flanges respectively extending in opposite directions transversely away from the vertical slab, the second flange being significantly wider than the first flange, the vertical slabs extending vertically throughout the full height of the walls and having a height which many times exceeds the thickness of the vertical slab, the horizontal slab having a width which many times exceeds the thickness thereof, a first one of the building modules having a vertical slab with an end portion extending endwise away from the adjacent terminal end of the horizontal slab, said end portion of the vertical slab having an upper edge which underlies and supports the horizontal slab of a second one of the building modules.

2. The building according to claim 1 and the second of the building modules having an open and unobstructed space beneath the horizontal slab thereof and receiving the end portion of said first one of the building modules.

3. The building according to claim 1 wherein the end portion of the vertical slab of the first one of said building modules engages against the vertical slab of said second of the building modules.

4. The building according to claim 1 wherein a pair of said building modules adjoin each other and have their vertical slabs spaced from each other to provide access into the room space embraced by the multiplicity of building modules.

5. The building according to claim 1 and one of the elongate horizontal slabs of one of the building modules having an end portion extending endwise away from the terminal end of the vertical slab thereof.

6. The building according to claim 1 and one of the building modules having horizontal and vertical slabs with terminal ends adjoining each other.

7. The building according to claim 1 and a first end of one of the building modules having adjoining end edges confronting another of the building modules, at least one of the end edges of said first end bearing against an edge of a slab of said another building module.

8. The building according to claim 1 wherein the first flange of the horizontal slab of certain of the modules having an upturned longitudinally extending lip adjacent the side edge thereof.

9. The building according to claim 1 and including a third of said building modules wherein an end portion of the vertical slab and an adjacent end portion of the first flange both extend endwise from the adjacent terminal end of the second wider flange, said end portion of the vertical flange of the third building module defining a supporting ledge upon which one of the horizontal slabs of an adjacent building module is supported.

10. The building according to claim 1 and including a precast wall module adjacent one of the building modules and having an elongate vertical slab extending vertically throughout the full height of the walls and with a height many times exceeding the thickness thereof and also having a top edge with a width substantially less than the thickness of the vertical slab, and the wall module also having an elongate horizontal flange formed adjacent to and above said top edge and in one piece with and integrally of the vertical slab, said top edge underlying and supporting one of the horizontal flanges of an adjacent building module.

11. The building according to claim 1 and one of said building modules having openings formed through the vertical slab thereof and providing access into and out of an adjacent room space.

12. The building according to claim 1 and one of the building modules having an elongate upstanding rib on the horizontal slab.

13. The building according to claim 1 and one of the building modules having a plurality of elongate and substantially parallel ribs on the horizontal slab and defining a duct therebetween.

14. The building according to claim 1 wherein at least one of the building modules having a pair of elongate upstanding ribs on and extending longitudinally along the horizontal slab and defining a channel therebetween, the channel being disposed in superposed relation with the vertical slab therebeneath and receiving the vertical slab of another of the building modules therein.

15. The building according to claim 1 and said multiplicity of building modules including a pair of adjacent modules with horizontal slabs having transverse end edges in addition to said longitudinal side edges, one of said edges of each of said modules of the pair of building modules abutting and bearing against one of the edges of the other module of the pair of modules.

16. The building according to claim 15 wherein the abutting and bearing edges of the horizontal slabs include one longitudinal side edge and one transverse end edge engaging each other.

17. The building according to claim 15 wherein the abutting and bearing edges of the horizontal slab are both longitudinal side edges.

18. The building according to claim 17 wherein the abutting and bearing longitudinal side edges are both on the second flanges of the pair of adjacent building modules.

19. The building according to claim 15 wherein the abutting and bearing edges of the horizontal slabs having recesses formed therein and communicating with each other and receiving connecting concrete filling the recesses and connecting the adjacent building modules to each other.

20. The building according to claim 19 and including steel reinforcing rods in the building modules and protruding in each of the edge recesses and cooperating with the connecting concrete to secure the adjacent building modules together.

21. The building according to claim 1 wherein said first one of the building modules having a vertical slab with both opposite end portions extending endwise away from the adjacent terminal ends of the horizontal slab.

22. The building according to claim 21 and both of said opposite end portions of the first one of the building modules underlying and supporting horizontal slabs of adjacent building modules.

23. The building according to claim 1 and including a precast wall module adjacent one of the building modules and having an elongate vertical slab extending vertically throughout the full height of the walls and with a height many times exceeding the thickness thereof, the vertical slab having a top edge underlying and supporting one of the flanges of an adjacent building module.

24. The building according to claim 23 wherein said wall module has a pair of longitudinally extending ribs upstanding in spaced relation along the length of the upper portion of the vertical slab and defining a longitudinal recess therebetween.

25. The building according to claim 24 wherein the two longitudinal ribs on the vertical slabs are of substantially equal height, both of the ribs supportively underlying one of the flanges of the horizontal slab of an adjacent building module.

26. The building according to claim 24 wherein said two longitudinal ribs have different heights, one rib being of lower height and the other rib being of higher height, the rib of lower height supportively underlying one of the flanges of the horizontal slab of an adjacent building module.

27. The building according to claim 24 wherein the horizontal slab which overlies said ribs and a recess therebetween has a plurality of perforations therein which communicate with said recess between the ribs, and a quantity of connection concrete filling said recess and said perforations.

* * * * *